United States Patent [19]

Boyer et al.

[11] Patent Number: 4,942,838

[45] Date of Patent: Jul. 24, 1990

[54] INFLATABLE WATERCRAFT WITH PORTABLE ENGINE PACKAGE

[75] Inventors: Kirk A. Boyer, Lino Lakes; Shigeki Yonezawa, Coon Rapids, both of Minn.

[73] Assignees: Yamaha Hatsudoki Kabushiki Kaisha; Sanshin Kagyo Kabushiki Kaisha, both of Japan

[21] Appl. No.: 370,845

[22] Filed: Jun. 23, 1989

[51] Int. Cl.[5] ..... B63B 7/08

[52] U.S. Cl. ..... 114/345; 440/38; 74/491

[58] Field of Search ..... 114/345, 363, 144 R; 440/38, 40–43, 89; 244/232–234; 74/491

[56] References Cited

U.S. PATENT DOCUMENTS

| | | | |
|---|---|---|---|
| 2,402,724 | 6/1946 | Bidwell | 114/144 R |
| 3,935,607 | 2/1976 | Cautwell et al. | 114/345 |
| 3,957,207 | 5/1976 | Chronic | 440/41 X |

FOREIGN PATENT DOCUMENTS

| | | | |
|---|---|---|---|
| 2375085 | 8/1978 | France | 114/345 |
| 0110589 | 7/1982 | Japan | 440/38 |
| 2032871 | 5/1980 | United Kingdom | 114/345 |

*Primary Examiner*—Joseph F. Peters, Jr.
*Assistant Examiner*—Edwin L. Swinehart
*Attorney, Agent, or Firm*—Haugen and Nikolai

[57] ABSTRACT

A manually transportable, internal combustion engine driven personal watercraft is described. It comprises a rigid, relatively thin fiberglass or other suitable plastic hull with inflatable tubular fabric reinforced sidewalks extending along opposed side edges of the hull from the stern to the bow. Insetted into the hull is a baseplate on which an IC engine/pump module can be readily coupled and uncoupled. The baseplate includes a water inlet scoop in fluid communication with the pump's inlet and an exhaust port which becomes aligned with the exhaust outlet of the IC engine when the two are joined. The pump's high pressure water outlet is pointed in the aft direction above the waterline and the craft is propelled by the reaction force resulting from the high velocity water jet.

7 Claims, 2 Drawing Sheets

INFLATABLE WATERCRAFT WITH PORTABLE ENGINE PACKAGE

BACKGROUND OF THE INVENTION

I. Field of the Invention:

This invention relates generally to marine craft and more particularly to an extremely lightweight, easily transportable personal watercraft for recreational and other boating purposes.

II. Discussion of the Prior Art:

Recreational boating has become a very popular past time, not only in the United States, but throughout the world. Most small size personal watercraft are of a size and weight requiring a trailer to transport them to and from the launch site. Depending upon an individual's lifestyle and living accommodations, the use of a trailer may be precluded. For example, apartment dwellers in many locations do not have the space available to them for storing a boat and trailer when not in use. Still other types of recreational boats include the canoe. While a canoe may be transported atop the roof of an automobile, such a watercraft must be paddled, although it is also possible to power a canoe with an outboard motor of some type. A further drawback of the canoe is its relative instability in water and is somewhat prone to tipping.

Thus, a need exists for a personal watercraft which can be safely used, which is motor-powered and which can be readily transported to and from an launch site by a single person and without the use of a trailer. The present invention provides such a watercraft.

SUMMARY OF THE INVENTION

It is accordingly a principal object of the present invention to provide an improved personal watercraft for recreational and utilitarian purposes.

Another object of the invention is to provide a personal watercraft which may readily be manually carried and easily transported by automobile and without a trailer.

Another object of the invention is to provide a marine craft which is small in size, light in weight, very stable in water and easily operated using a single control mechanism.

Yet another object of the invention is to provide a personal watercraft which is jet propelled and which thus does not require an exposed propeller.

In accordance with the present invention, the foregoing objects and advantages are achieved by providing an inflatable boat having a power module which may easily be coupled and uncoupled from the boat so that the two may be separately carried to and from the launch site but which can then be readily joined. The inflatable watercraft comprises a rigid hull having in its plan view a generally rectangular aft portion which tapers toward and curves upwardly toward a point at the bow. Fastened to the upper surface of the hull member are tubular inflatable members which are generally circular in cross section and which are shaped so that when joined end-to-end conform to the periphery of the rigid hull.

Fitted into the rigid hull member proximate the aft portion thereof is a baseplate having a water scoop projecting beneath the lower surface of the hull and communicating with an opening in the baseplate. The power module comprises an internal combustion engine whose output shaft directly drives the impeller of a centrifugal pump. The inlet of the pump is in fluid communication with the opening formed in the baseplate such that water brought in through the scoop will be acted upon by the pump. The pump's outlet is directed generally horizontally at a location above the waterline of the craft. A further exhaust port is formed through the baseplate and is in fluid communication with the exhaust port of the internal combustion engine. Thus, exhaust gas and noise are directed down into the water.

Clamping means are provided for rapidly coupling and uncoupling the power module or pod relative to the hull and on the baseplate.

The operator is seated on a seat member which is suspended by springs or elastic bands from the inflatable tubes and within easy reach is a joystick control which provides for steering, starting and stopping, and speed. The joystick is connected by cables to the power pod and a clamp device is used to secure it in place on one of the inflatable tubes. Steering is achieved by controlling the direction at which the water leaves the pump's high pressure outlet port.

By providing a relatively lightweight power module readily separable from the lightweight, rigid hull, inflatable watercraft, an adult, with relative ease, can lift the watercraft atop a car or station wagon and place the power module in the trunk for transportation.

The foregoing features and advantages of the invention will become more apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
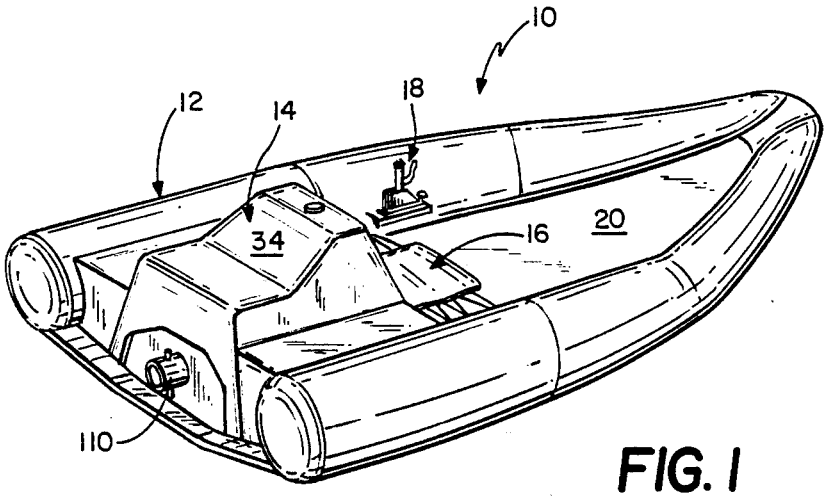
FIG. 1 is a perspective view of the watercraft in accordance with a preferred embodiment thereof.
Figure 2:
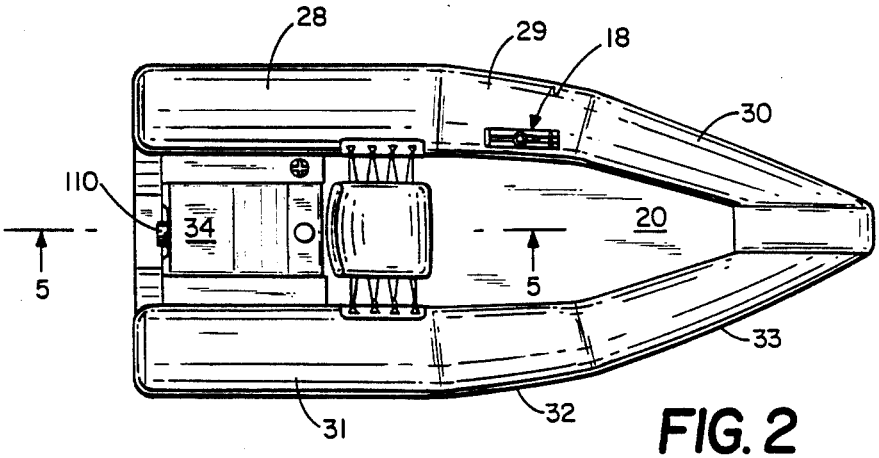
FIG. 2 is a plan view of the watercraft of FIG. 1.
Figure 3:
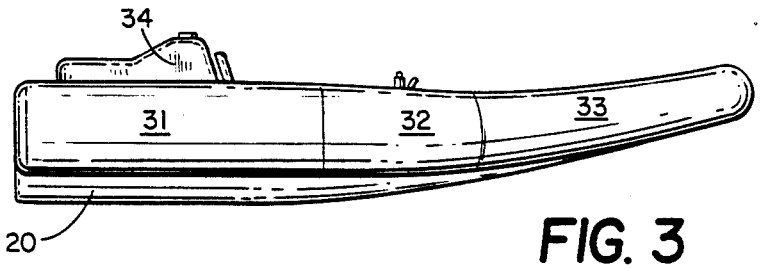
FIG. 3 is a side elevation of the watercraft of FIG. 1.
Figure 4:
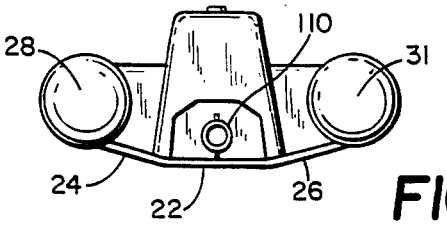
FIG. 4 is a rear view of the watercraft of FIG. 1.

Referring first to FIG. 1, there is indicated generally by numeral 10 the watercraft made in accordance with the present invention. It includes three principal subassemblies, namely, the inflatable boat 12, its power module 14, its seat assembly 16 and its hand control or joystick 18. The boat portion 12 includes a rigid hull member 20 which is preferably molded from fiberglass or other suitable plastic material and may typically be approximately two millimeters thick. As best seen in the plan view of FIG. 2, the hull 20 is generally rectangular in its aft one-third and then the side edges of the hull taper toward a point proximate the bow. FIG. 3 reveals the upward sweep of the bow. When viewed from the rear as in FIG. 4, the aft portion can be seen to include a generally flat middle section 22 flanked on both sides by upwardly and outwardly sloping side sections 24 and 26. It is found that a slope angle of about 15 degrees with the horizontal provides excellent characteristics.

Bonded to the upper surface of the rigid hull 20 are inflatable tubular chambers 28, 29, 30 and 31, 32, 33 which, when positioned end-to-end, form the sides of the watercraft. The tubes may be made from a multiply fabric variety of synthetic fibers including nylon or other polyesters and laminated with rubberized material, such as NEOPRENE®, which exhibits superior air retention. Externally, the polyester core is coated with two additional layers of NEOPRENE® which provides strength and flexibility. A coating of HYPALON® or KELVAR® is then used on the outer layer to provide abrasion resistance and ultraviolet ray protection against the combined effects of water and sun. Rather than using one continuous tube, it has been proven expedient to construct the tubes from a plurality of contiguous inflatable chambers in that, should one such chamber accidentally be punctured in use, the entire tube configuration would not become deflated. As seen in FIG. 1, the tubular segments 28 and 31 in the aft portion of the craft are of a larger diameter than the tubular segments 30 and 33 surrounding the bow. Furthermore, the tubes 30 and 33 at the bow portion curve upwardly and thus conform to the curvature of the hull (see FIG. 3).

The power module 14 includes an outer shroud or cover 34 beneath which is located an internal combustion engine 36 which is positioned within the shroud 34 such that the cylinder heads 37 are horizontal and the motor's output shaft 40 extends vertically. The output impeller plate 39 40 directly drives the shaft of the centrifugal pump 38. The fuel tank is identified by number 41.

Figure 5:
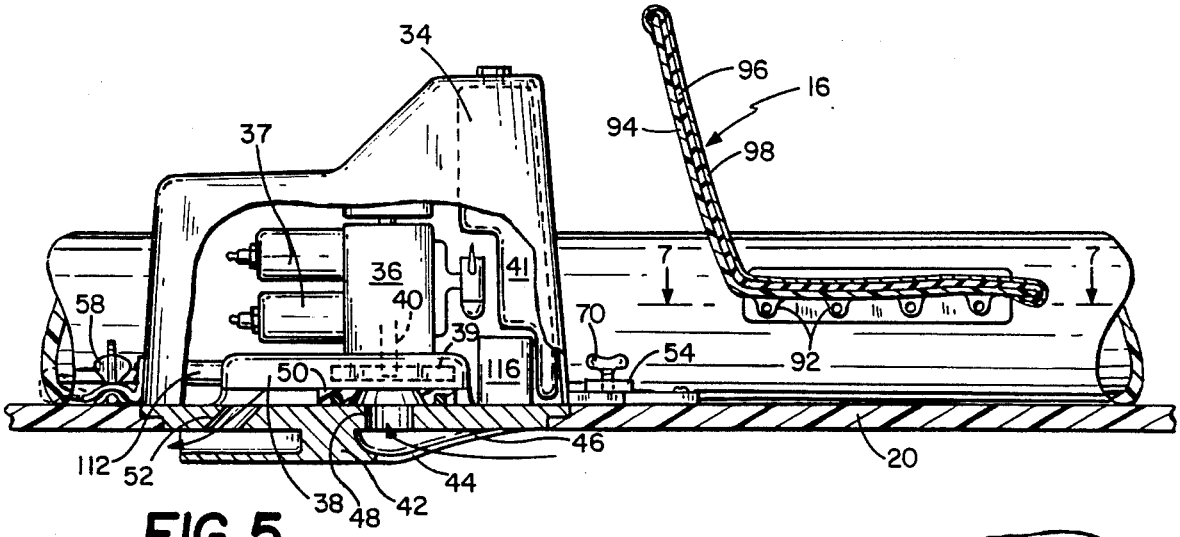
FIG. 5 is a cross-sectional view taken along the line 5—5 in FIG. 2.

The power module 14 is positioned over a baseplate 42 which is inset in the center portion 22 of the hull 20. As seen in FIG. 5, the baseplate includes a front-facing scoop 44 covered by a grate 46 to screen out foreign materials which may be found in the water. The water flowing through the grate passes upward through a bore 48 formed in the baseplate and directly into the centrifugal pump's intake port. A compressible gasket 50 surrounds the bore 48 preventing water from leaking out around the pump's inlet and preventing the pump from drawing air which would otherwise markedly reduce its power output. By locating the scoop on the flat center portion 22 of the hull, and by providing sloping panels 24 and 26 on opposite sides, water, without air, is made to flood the scoop as the craft is propelled through the water. This minimizes any tendency toward cavitation in the pump. When on-plane, the tubes are no longer in the water, thus reducing the water resistance. When not on-plane, the air-filled tubes provide the desired buoyancy and stability.

A second bore 52 formed through the baseplate 42 exits to the rear and is in fluid communication with the engine's exhaust line (not shown). Hence, the exhaust gases from the engine exit beneath the craft and into the water, thus serving to attenuate exhaust noise.

Figure 6:
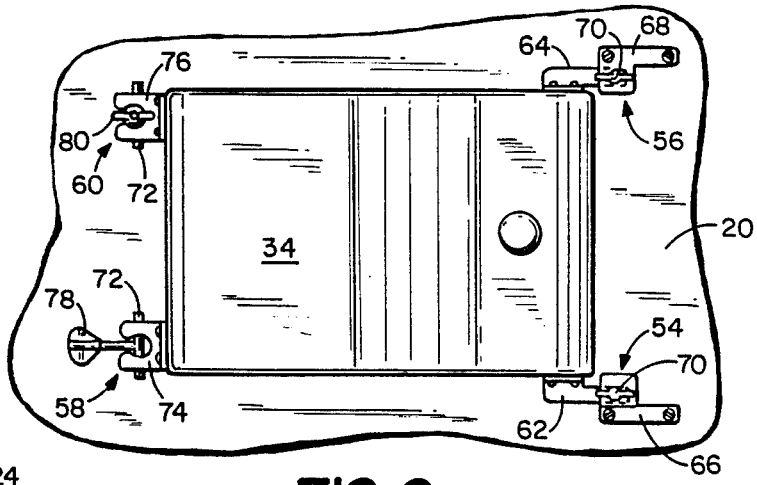
FIG. 6 is an enlarged plan view showing the manner in which the power module is removably clamped to the hull.

Referring to FIGS. 5 and 6, the power module 14 is removably attached to the baseplate by means of front screw clamps 54 and 56 and rear pivot ball clamps 58 and 60. Specifically, brackets 62 and 64 attach to the housing or shroud clamps 54 and 56 and rear pivot ball clamps 58 and 60. Specifically, brackets 62 and 64 attach to the housing or shroud 34 and when positioned on the base plate 40 slip beneath clamp members 66 and 68. Thumb screws 70 pass through threaded holes in the clamp members 66 and 68 such that when the thumb screws 70 are turned, the front edge of the power pack is pressed downward. The rear pivot ball clamps 58 and 60 are arranged to rotate about pins 72 so that when extending horizontally, the rear edge of the power module is unclamped. By swinging clamps 58 and 60 vertically, they pass into slots in the clamp brackets 74 and 76. Now, when the knobs 78 and 80 are turned on their threaded shafts, a downward force is applied to the rearmost edge of the power module. The combination of the front and rear clamps insure that when the motor module is clamped to the boat, the gasket 50 will be tightly compressed to preclude leakage of either air or water.

Figure 7:
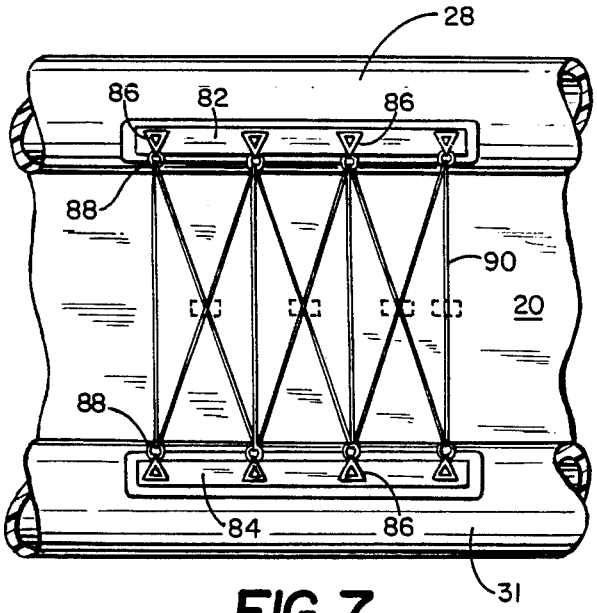
FIG. 7 is a detailed view taken along the line 7—7 in FIG. 5 showing the seat support structure.

The seat assembly includes a pair of hook straps 82 and 84 which are adhesively and/or thermally bonded to the inside walls of the tube segments 28 and 31. Each of the hook straps includes a plurality of hooks 86 which are arranged to receive rings as at 88 through which an elastic cord 90 is threaded, as best seen in FIG. 7. The elastic cord 90 is also threaded through eyelets 92 on the underside of the seat 16 (FIG. 5). In this fashion, the seat is resiliently supported. Because of the fact that the elastic cord 90 extends back and forth between opposed side tubes 28 and 31, a certain amount of damping takes place to limit trampolining.

As seen in the cross-sectional view of FIG. 5, the seat 16 itself includes a molded fiberglass base 94 which is then covered by a layer 96 of a closed cell foam material and a decorative vinyl cover 98. Because of the hook and ring arrangement, the seat assembly may readily be removed as a unit from the watercraft during transportation.

Figure 8:
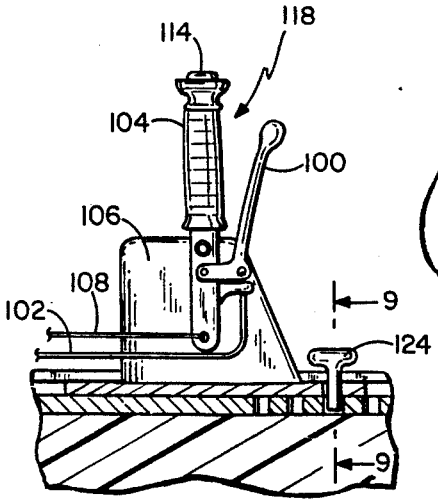
FIG. 8 is a side cross-sectional view illustrating the mode of attachment of the control joystick to the inflatable tubes of the watercraft.
Figure 9:
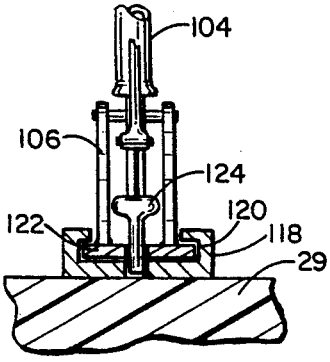
FIG. 9 is an end view taken along the line 9—9 in FIG. 8.

The operation of the watercraft is controlled by a joystick assembly 18. As seen in FIGS. 8 and 9, the joystick assembly includes a throttle lever 100 coupled through a conventional control cable 102 to the engine's throttle butterfly plate (not shown).Steering is accomplished by operating the handle 104 which is pivotally joined to a vertically extending mounting bracket 106. Its control cable 108 connects to a tubular sleeve 110 which is pivoted about a vertical axis directly behind the pump's high pressure outlet port 112 (FIG. 5). The outlet 112 is pointed aft at a location above the hull member as can be seen in FIG. 5. By manipulating the lever 104, the tubular sleeve 110 may be positioned to divert the jet flow and thus the direction of the reaction force vector acting on the watercraft.

Located atop the steering control lever 104 on the joystick is a push button switch 114 used to connect the storage battery 116 in the power module 14 to the engine's starter motor.

The joystick is removably fastened to the inflatable tube segment 29 by a bracket 118 (FIG. 9) bonded to the tube. The bracket 118 includes a dove-tail groove 120 into which may be fitted a flange 122 forming a base for the mounting bracket 106. A pin 124 passing through aligned holes in the flange and bracket locks the two in place. However, when the pin is pulled, the joystick can be uncoupled from the inflatable boat and carried as a part of the power module to which its cables 102 and 108 attach. By providing a plurality of longitudinally spaced holes in the bracket 118, the joystick can be positioned at a point most comfortable to the operator (FIG. 8).

In accordance with the foregoing, the resulting watercraft had a body weighing only about 50 pounds and an engine module weighing 80 pounds when filled with two gallons of gas. Because the two are readily separable and joinable, they can be carried as separate units. Moreover, the boat portion may readily be placed atop an automobile, van or station wagon. Because of the material from which the inflatable tubes are made, when placed on a car roof tube-side-down, there is no fear that the finish on the car will be damaged.

The length and width of the boat portion can be designed so that it may readily be carried on the swim platform of a cruiser and usable as a auxiliary watercraft for running errands and the like when the larger craft is beached for extended periods.

This invention has been described herein in considerable detail in order to comply with the patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A manually portable watercraft comprising, in combination:

(a) a rigid hull member having a relatively wide, generally rectangular stern portion tapering to a more narrow bow portion;

(b) a plurality of tubular inflatable chamber members secured to said hull member and extending along the opposed side edges thereof from said stern portion to said bow portion;

(c) a baseplate permanently inset in said hull member midway between said opposed side edges proximate the stern portion, said baseplate including a water inlet port extending therethrough;

(d) a manually portable internal combustion engine driven pump module, the pump in said module having a low pressure water inlet and a high pressure water outlet;

(e) deflector means pivotally coupled about a vertical axis relative to said high pressure water outlet for controlling the direction of the water stream exiting said outlet;

(f) means for rapidly coupling and uncoupling said module to said hull member over said baseplate such that when said module is coupled to said hull member, said low pressure water inlet of said pump is in fluid communication with said water inlet port in said baseplate and said high pressure water outlet is pointed in the aft direction at a location above said hull member; and (g) a joystick lever means releasably attached on one of said inflatable chamber members at a location in reach of an operator to be removable with said module and said joystick lever means being adapted to be connected to said deflector means for pivoting said deflector means.

2. The watercraft as in claim 1 wherein said baseplate further includes an exhaust gas outlet port.

3. The watercraft as in claim 1 and further including a removable seat member resiliently supported between ones of said plurality of chamber members attached to opposed side edges of said rigid hull member.

4. The watercraft as in claim 1 wherein said said joystick lever means includes a throttle control lever adapted to be coupled to said engine.

5. The watercraft as in claim 4 wherein said joystick lever means further includes an engine start switch.

6. The watercraft as in claim 1 wherein said engine driven pump module comprises:

(a) a housing;

(b) a multicylinder internal combustion engine mounted in said housing with its crankshaft extending vertically downward; and (c) a centrifugal pump having an impeller plate journaled in a pump housing for rotation about a vertical axis and coupled to said crankshaft, said pump housing including said low pressure water inlet disposed beneath said impeller plate with a seal means surrounding said water inlet, said high pressure water outlet being disposed tangentially of said impeller plate.

7. The watercraft as in claim 6 wherein said means for rapidly coupling and uncoupling said module to said hull member comprises:

(a) front clamp means attached to said housing and to said hull member for selectively applying a compressive force between said seal means surrounding said water inlet port on said baseplate and said low pressure water inlet on said pump; and (b) rear clamp means pivotally joined to said hull and to said housing for selectively applying seal means surrounding said water inlet port on said baseplate and said low pressure water inlet and said pump while preventing rearward movement of said housing relative to said baseplate.

* * * * *